US005555630A

United States Patent [19]

De Souza

[11] Patent Number: 5,555,630

[45] Date of Patent: Sep. 17, 1996

[54] COMPASS WITH SAFETY PIVOT

[76] Inventor: Etienne N. De Souza, 5 rue Charles Koenig, 6800 Colmar, France

[21] Appl. No.: 397,119

[22] PCT Filed: Sep. 8, 1993

[86] PCT No.: PCT/FR93/00860

§ 371 Date: Mar. 7, 1995

§ 102(e) Date: Mar. 7, 1995

[87] PCT Pub. No.: WO94/05514

PCT Pub. Date: Mar. 17, 1994

[30] Foreign Application Priority Data

Sep. 8, 1992 [FR] France ..... 92/10720
Dec. 10, 1992 [FR] France ..... 92/15000

[51] Int. Cl.[6] ..... B43L 9/02

[52] U.S. Cl. ..... 33/27.02

[58] Field of Search ..... 33/27.02, 27.03, 33/27.06, 558.01, 558.2, 558.3, 558.4

[56] References Cited

U.S. PATENT DOCUMENTS 595,607 12/1897 Coykendall ..... 33/27.02
2,074,102 3/1937 Christy .
2,718,703 9/1955 Chilcote ..... 33/27.02

FOREIGN PATENT DOCUMENTS 439396 6/1912 France .
1323435 4/1963 France .
2036802 12/1970 France .
211358 12/1908 Germany .
3219736 12/1983 Germany .
172379 8/1960 Sweden ..... 33/27.02
360507 4/1962 Switzerland .

*Primary Examiner*—William A. Cuchlinski, Jr.
*Assistant Examiner*—G. Bradley Bennett
*Attorney, Agent, or Firm*—Davis, Bujold and Streck, P.A.

[57] ABSTRACT

A compass (1) with safety pivot is disclosed for drawing arcs or complete circles on a surface without perforating it and in an absolutely safe manner for young users. The safety pivot of said compass has a rounded end at the end of a pin (8) housed in the body (9). Said rounded end is partially or fully covered by a non-slip finish (7') designed-to be in contact with said drawing surface to define the centre of the arc or circle to be drawn.

1 Claim, 1 Drawing Sheet

COMPASS WITH SAFETY PIVOT

Figure 1:
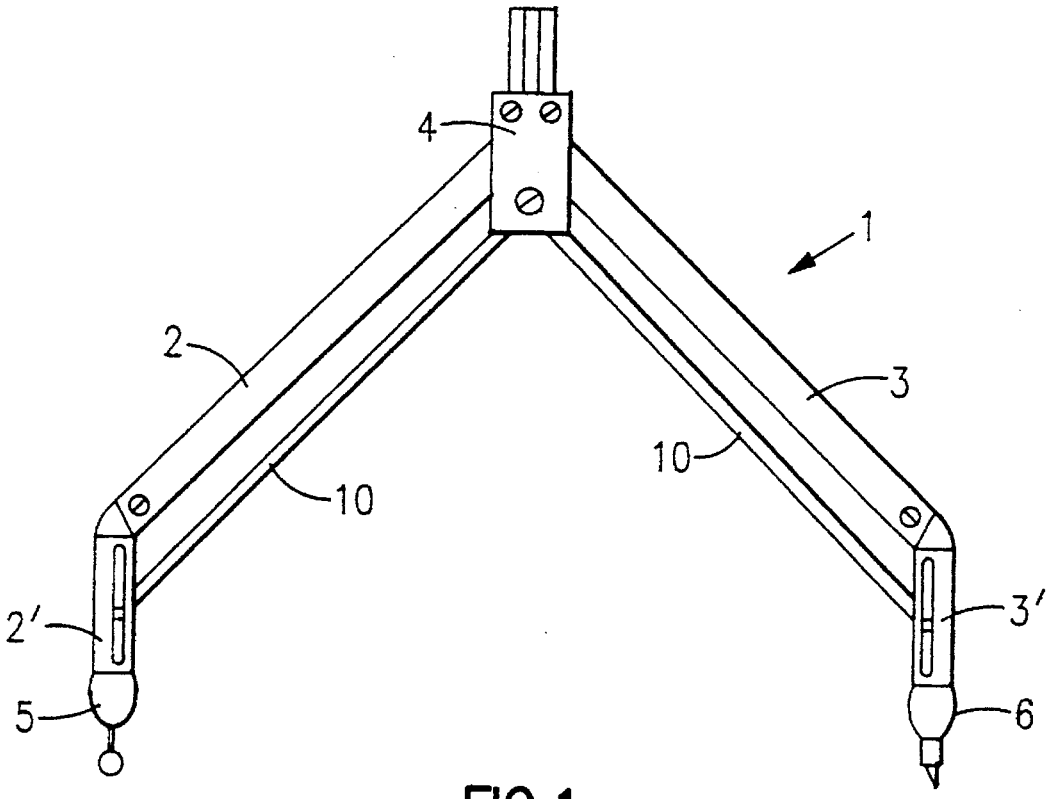

The present invention relates to a compass with safety pivot for drawing arcs of a circle or complete circles on a surface, this compass comprising two branches which are articulated at their common ends, one of the branches being fitted with a safety pivot and the other with a propelling pencil or pencil holder.

The compasses on sale in stores all have a pivot in the form of a sharp point defining the centre of the circle or arc of a circle to be drawn. Said point presents two drawbacks as it is clearly dangerous, particularly for young users, and secondly it pierces the surface which may be a nuisance for the user.

The object of the present invention is a compass equipped with a safety pivot making it possible to avoid the above-mentioned drawbacks while being able to draw in a stable and precise manner.

There are admittedly inventions designed to improve handling and drawing with a compass: either with the aim of making the mathematician's work easier—such as Mr GOMEZ BARQUERO's invention (FR-A-A 1323435), or to make it easier to draw circles on a blackboard—such as the inventions of Messrs. CHRISTY (U.S. Pat. No. 2,074,102) and ZWEIFEL (CH-A-360 507), or to treat the drawing surface with care as proposed by Mr SCHMITZ-NEUBER's invention (DE-A3 219 736).

Unlike the inventions mentioned, the compass with safety pivot, which is particularly designed with the user's safety in mind, makes the following innovations:

the sharp point is done away with, the pivot's contact area with the drawing surface is carefully designed, the pivot rotates around the vertical axis.

It is also worth noting that the present invention allows the compass to retain the ergonomic qualities of the instrument just as it is currently designed, manufactured and sold to the public.

The invention concerns a compass of the type mentioned in the introduction, characterized in that said safety pivot comprises a rounded end located at the end of a pin housed in a body and in that said rounded end is partially or fully covered with a non-slip finish designed to be in contact with said drawing surface to define the centre of the circle or the arc of a circle to be drawn.

In a preferred form of embodiment, the rounded end is partially or completely spherical. Said rounded end can rotate around its axis, in relation to the fixed body of said pivot.

Preferably, the branches of the compass are in two articulated parts and the two lower parts are connected to a return mechanism provided to position them along an axis perpendicular to said surface.

Figure 2:
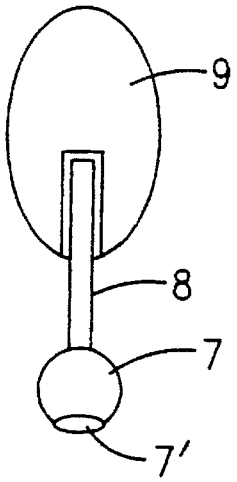

The present invention and its advantages shall be more fully understood in the following description of an example of embodiment, with reference to the attached drawings, in which FIG. 1 represents an elevation of a compass according to the invention and FIG. 2 is an enlarged cutaway view of the safety pivot mentioned in the invention.

With reference to the figures, the compass 1 is comprised of two branches 2 and 3, articulated at their common ends at 4. Each branch has an articulated part 2' and 3' at the end. A return mechanism, comprised here of a rod 10, makes it possible to keep the lower parts of each branch 2' and 3' perpendicular to the drawing surface, whatever the opening angle of the compass. One of the branches is fitted with a safety pivot 5 and the other with a propelling pencil or pencil holder 6. The pivot comprises a fixed body 9 housing a mobile pin 8, which itself has a spherical point on the end 7 covered with an anti-slip finish 7'.

The present invention is not restricted to the example of embodiment described above and can be widened to include any alternative or modification which is obvious to the expert. In particular, the safety pivot as described can be adapted to any instrument used for drawing around an axis.

I claim:

1. A compass with a safety pivot for drawing at least one of arcs and circles on a drawing surface, the compass comprising two branches (2, 3) which are articulated at a common end (4), the first branch (2) being equipped with a safety pivot (5) and the second branch (3) being equipped with one of a pencil and a pencil holder (6), each of the two branches comprising first and second parts (2, 2' and 3, 3'), each respective first part (2, 3) connecting a respective second part (2', 3') to the common end (4), each of the second parts (2', 3') being connected to a return mechanism (10), supported by the common end (4), for positioning the second parts (2', 3') along an axis perpendicular to the drawing surface;

wherein the safety pivot (5) comprises a pin (8) housed in a fixed body (9), the pin (8) has a rounded end (7) at a remote end thereof and the rounded end (7) is rotatable about an axis in relation to the fixed body (9), the rounded end (7) is at least partially spherical, and the rounded end (7) is at least partially covered with a non-slip finish (7') for contacting the drawing surface to define the center of one of a circle and an arc to be drawn.

* * * * *